US006478903B1

(12) United States Patent
John, Jr. et al.

(10) Patent No.: US 6,478,903 B1
(45) Date of Patent: Nov. 12, 2002

(54) NON-TOXIC PRIMER MIX

(75) Inventors: Henry J. John, Jr., Jacksonville, AR (US); Carolyn Yeager, Romance, AR (US); Don Pile, Cabot, AR (US); Tim Webb, Rogers, AR (US)

(73) Assignee: RA Brands, LLC, Madison, NC (US)

( * ) Notice: Subject to any disclaimer, the term of this patent is extended or adjusted under 35 U.S.C. 154(b) by 113 days.

(21) Appl. No.: 09/680,803

(22) Filed: Oct. 6, 2000

(51) Int. Cl.[7] ..... C06B 45/06; C06B 31/02

(52) U.S. Cl. ..... 149/18; 149/38; 149/43; 149/61; 149/62; 149/63

(58) Field of Search ..... 149/18, 37, 38, 149/43, 44, 61, 62, 63

(56) References Cited

U.S. PATENT DOCUMENTS

| | | | | | |
|---|---|---|---|---|---|
| 3,741,585 | A | * | 6/1973 | Hendrickson et al. | 149/35 |
| 3,779,823 | A | * | 12/1973 | Price et al. | 149/19.4 |
| 4,363,679 | A | | 12/1982 | Hagel et al. | 149/37 |
| 4,581,082 | A | | 4/1986 | Hagel et al. | 149/105 |
| 4,674,409 | A | | 6/1987 | Lopata et al. | 102/471 |
| 5,167,736 | A | | 12/1992 | Mei et al. | 149/22 |
| 5,216,199 | A | | 6/1993 | Bjerke et al. | 102/471 |
| 5,388,519 | A | | 2/1995 | Guindon et al. | 102/292 |
| 5,437,229 | A | * | 8/1995 | Taylor et al. | 102/288 |
| 5,538,569 | A | | 7/1996 | Carter | 149/105 |
| 5,561,260 | A | * | 10/1996 | Towning et al. | 149/19.3 |
| 5,567,252 | A | | 10/1996 | Mei et al. | 149/22 |
| 5,585,594 | A | * | 12/1996 | Pelham et al. | 149/19.3 |
| 5,610,367 | A | | 3/1997 | Erickson et al. | 149/35 |
| 5,654,520 | A | * | 8/1997 | Boberg et al. | 149/37 |
| 5,684,268 | A | | 11/1997 | Lopata | 149/39 |
| 5,831,208 | A | | 11/1998 | Erickson | 149/18 |
| 5,993,577 | A | | 11/1999 | Erickson et al. | 149/68 |

* cited by examiner

*Primary Examiner*—Edward A. Miller
(74) *Attorney, Agent, or Firm*—Womble Carlyle Sandridge & Rice, PLLC

(57) ABSTRACT

A non-toxic primer mix including both bismuth sulfide and potassium nitrate as the pyrotechnic portion of the primer is disclosed. In a further embodiment, a non-toxic primer mix comprising zinc sulfide and aluminum nitrate as the pyrotechnic portion of the primer mix is disposed. Bismuth and zinc sulfide act as fuels for the oxidizers of potassium and aluminum nitrate in providing an ignition flame for the primer. The non-toxic primer mix further contains a lead-free explosive material, and additionally can include added fuels, sensitizers, explosives and binders.

11 Claims, No Drawings

NON-TOXIC PRIMER MIX

FIELD OF INVENTION

The present invention generally relates to explosives and more particularly to a primer charge.

BACKGROUND

The smallest component in small arms ammunition, the percussion primer, is the link between the striking of the firing pin and the explosion of the projectile out of the cartridge casing. Percussion primers or primer mixes generally have undergone only gradual changes since their original development. For a time, mercury fulminate was the most commonly used primer mix. In the 1920s, alternate priming mixes were found to replace mercury fulminate, as this latter composition was found to deteriorate rapidly under tropical conditions and cause potential health problems or concerns such as lethargy and nausea to the shooter after firing. However, the alternate mixes, based on lead thiocyanate/potassium chlorate formulations were soon recognized as detrimental to weapon barrels because of the formation of corrosive water soluble potassium chloride salts upon combustion. Later primer mixes were based on the primary explosive lead styrphnate, a substance which is much more stable than mercury fulminate and is still in use today.

Except for the use of pure mercury fulminate as an igniter, most commonly used primer mixes are chemical mixtures comprising at least a primary explosive, an oxidizing agent and a fuel source. Lead styphnate is the most common primary explosive, with tetrazene typically being added as a secondary explosive for rendering the lead styphnate composition sufficiently sensitive to percussion. The most common oxidizing agent is barium nitrate, which is combined with a fuel, antimony sulfide. Friction producing agents and additional fuels are also added. Unfortunately, lead, antimony and barium are highly toxic, and therefore pose a potential health hazard, particularly when used within an enclosed shooting range where they can accumulate in the atmosphere and on surfaces.

Accordingly, attempts have produced a non-toxic primer composition. The phrase "non-toxic" is intended to mean a substance consisting essentially of materials which are not toxic heavy metals such as lead or barium, known carcinogens or poisons, especially when vaporized, burnt or exploded as in the firing of an ammunition round. In the product ion of non-toxic primer mixes, diazodinitrophenol (DDNP) is often a preferred substitute for lead styphnate as the primary explosive. DDNP is both slightly insoluble in water and is desensitized by water for safer processing. Like lead styphnate, DDNP typically is accompanied by tetrazene as a secondary primary explosive to render the composition sufficiently sensitive to percussion.

While considerable attention has been directed to removing lead from primer mixes, there has been less attention paid to the removal of remaining toxic components from the primer mix. Thus, toxic oxidizing agents and fuels, such as barium nitrate and antimony sulfide, still remain sources of concern. Both barium and antimony are highly toxic metals and their inclusion in the primer mix creates a toxic residue after firing. Accordingly, there exists a need for a non-toxic primer mix free of both lead and toxic oxidizers and fuels such as barium nitrate and antimony sulfide.

SUMMARY

The present invention generally comprises a composition and method of preparing a non-toxic primer mix including in one embodiment both bismuth sulfide and potassium nitrate as the pyrotechnic portion of the primer mix. In a further embodiment, zinc sulfide and aluminum nitrate are included as the pyrotechnic portion of the primer mix. Bismuth sulfide and zinc sulfide serve as non-toxic fuels for the non-toxic oxidizers of potassium nitrate and aluminum nitrate in the production of an ignition flame.

In greater detail, the non-toxic primer mix contains approximately 2–20% by weight bismuth sulfide, approximately 25–70% by weight potassium nitrate and approximately 25–50% by weight of a lead-free explosive material. Additionally, the primer can include additional fuels such as nitrocellulose, aluminum, manganese and manganese oxide. Furthermore, pentaerythritol tetranitrate (PETN) may be included as a primary explosive and gum arabic used as a binder.

The primer mix typically is wet processed during production for safety, and comprises the steps of combing water and on a dry weight percent approximately 20% by weight bismuth sulfide, approximately 25–70% by weight potassium nitrate, and approximately 25–50% by weight explosive material and then mixing. The wet formed primer mix can then be rolled and charged into percussion cups.

In an additional embodiment, the non-toxic primer mix contains approximately 2–20% by weight zinc sulfide, approximately 25–70% by weight aluminum nitrate and approximately 25–50% by weight of a lead-free explosive material. Additionally, the primer can include additional fuels such as nitrocellulose, aluminum, manganese and titanium. Furthermore, pentaerythritol tetranitrate (PETN) maybe included as a primary explosive and gum arabic used as a binder.

In a further embodiment, the primer mix is wet processed comprising the steps of combing water and on a dry weight percent approximately 2–20% by weight zinc sulfide, approximately 25–70% by weight aluminum nitrate, and approximately 25–50% by weight explosive material and then mixing. The wet formed primer mix can then be rolled and charged into percussion cups.

DETAILED DESCRIPTION

The present invention comprises a non-toxic primer mix including both bismuth sulfide and potassium nitrate as at least a portion of the pyrotechnic portion of the primer. Additionally, the present invention comprises a non-toxic primer mix including both zinc sulfide and aluminum nitrate as at least a portion of the pyrotechnic portion of the primer. Bismuth sulfide and zinc sulfide act as fuels for potassium nitrate and aluminum nitrate, which act as oxidizers, to provide an ignition flame. Typically the non-toxic primer mix contains approximately 2 to 20% by weight bismuth sulfide or zinc sulfide, approximately 25 to 70% by weight potassium nitrate or aluminum nitrate, and approximately 25 to 50% by weight of a lead-free explosive material. Additionally, the primer can include added fuels, such as nitrocellulose, and a binder, such as gum arabic.

Bismuth sulfide generally serves as the fuel or inflammable material in the pyrotechnic system of the non-toxic primer mix and is generally represented by the formula of $Bi_2S_3$. Bismuth sulfide is also known as bismuthinite, an ore of bismuth. Bismuth sulfide is non-toxic and non-carcinogenic as evidenced by the various uses of bismuth salts in the cosmetic and pharmaceutical industries. For example, bismuth pharmaceuticals are used in the treatment of stomach ulcers and other intestinal problems, or for external uses because of their astringent and slight antiseptic properties.

The bismuth sulfide component of the present primer mix generally is combined with the oxidizer (potassium nitrate) to produce the ignition flame for the combustion of the propellant charge. Bismuth sulfide is added on a dry weight percent basis at between about 2 to 20% by weight of the primer mix. In one embodiment, bismuth sulfide is added in amounts of about 5 to 15% by weight of the non-toxic primer mix. In a second embodiment, bismuth sulfide is added at about 11% by weight of the primer mix Various other ranges or amounts of the bismuth sulfide can be added to the primer mix as will be understood by those skilled in the art.

Potassium nitrate is added to the primer mix as an oxidizer and is generally represented by the formula of $KNO_3$. Potassium nitrate is also known as quick salt or saltpeter and is a very strong oxidizer that is free of toxic metal ions and upon combustion generally does not produce toxic or corrosive by-products. Potassium nitrate is combined with bismuth sulfide to produce the ignition flame. Additionally, potassium nitrate can be processed in the form of a wet mix. The potassium nitrate component generally is added on a dry weight percent basis between about 25 to 70% of the non-toxic primer mix. In an additional embodiment, potassium nitrate is added in an amount between about 35 to 55% of the non-toxic primer mix. In a further embodiment, the potassium nitrate is added at about 50% by weight of the primer mix.

In an alternative embodiment zinc sulfide generally serves as the fuel or inflammable material in the pyrotechnic system of the non-toxic primer mix and is generally represented by the formula of ZnS. Zinc sulfide occurs naturally as an off white powder blend that is typically prepared by the precipitation of a zinc salt solution with ammonium sulfide. Zinc sulfide is added on a dry weight percent basis at between about 2 to 20% by weight of the primer mix. In one embodiment, zinc sulfide is added in amounts of about 5 to 15% by weight of the non-toxic primer mix. In a second embodiment, zinc sulfide is added at about 11% by weight of the primer mix. Various other ranges or amounts of the zinc sulfide can be added to the primer mix as will be understood by those skilled in the art.

Aluminum nitrate is added to the primer mix as an oxidizer in combination with zinc sulfide and is generally represented by the formula of $Al(NO_3)_3$. Aluminum nitrate is combined with zinc sulfide to produce the ignition flame. Additionally, aluminum nitrate can be processed in the form of a wet mix. The aluminum nitrate component generally is added on a dry weight percent basis between about 25 to 70% of the non-toxic primer mix. In an additional embodiment, aluminum nitrate is added in an amount between about 35 to 55% of the non-toxic primer mix. In a further embodiment, the aluminum nitrate is added at about 50% by weight of the primer mix.

The primer mix additionally contains a lead-free explosive material that preferably acts as both an accelerant and sensitizer. The explosive material chosen generally is non-toxic and can include both a primary and secondary explosive. Preferably, the primer mix contains about 24 to 50% by weight explosive material. In an alternative embodiment, the primer contains between about 33 to 41% by weight explosive.

In one embodiment, diazodinitrophenol (DDNP) is chosen as the primary explosive. DDNP can be manufactured by the partial reduction of trinitrophenole and subsequent diazotation and is slightly insoluble in water. DDNP may be desensitized by immersing it in water where it does not react at normal temperature. The sensitivity of DDNP to friction is also less than that of mercury fulminate, but is approximately the same as that of lead azide. DDNP is not the only primary explosive compatible for use within that primer mix. For example, additional primary explosives can include potassium dinitrobenzofuroxane (KDNBP) and derivatives or mixtures thereof. The primary explosive is chosen for being both lead-free and non-toxic. Other primary explosives may be used in the present primer mix, either alone or in combination with those listed above, so long as the ballistic properties of the prepared primers are similar to or better than those of the lead styphnate based primers.

In one embodiment, the explosive portion of the composition preferably contains about 27 to 35% DDNP a, the primary explosive. In an alternative embodiment, DDNP comprises about 28% by weight of the primer mix. Typically, when DDNP is less than about 27% by weight of the primer mix, shock propagation is reduced, and when it is greater than 35%, shock velocity can increase above desired or preferred levels.

The secondary explosive is typically a sensitizer that accelerates the rate of conversion of the pyrotechnic system. There are a variety of sensitizers capable of being included in the present primer mix. In the present case, the sensitizer is selected in part for its compatibility with the chosen primary explosive. The sensitizer enhances the sensitivity of the primary explosive to the percussion mechanism. Additionally, friction agents, such as glass, may be used to enhance the sensitivity of the primary explosive. Furthermore, pentaerythritol tetranitrate (PETN) can be added to the primer mix to enhance the flame temperature to aid in igniting the propellant.

In an embodiment, tetrazene is selected as a secondary explosive to be combined with DDNP. Tetrazene, also known as tetracene, tetrazolyl guanyltetrazene hydrate or tetrazene-1-carboxamidine-4-(1-H-tetrazol-5-yl) monohydrate, typically added to the mix in combination with DDNP to increase the sensitivity of the charge. Tetrazene is typically added to the mix in an amount between about 4 to 11% by weight. For example, in one embodiment, tetrazene can comprise about 5% by weight of the primer mix. When tetrazene is added in amounts less than about 4% by weight, it becomes difficult to reliably incorporate it using typical manufacturing techniques, and with concentrations greater than about 11% by weight, there is an increase in the shock pressure beyond normally acceptable or desired limits.

The primer mix can further include an added fuel that comprises between about 2 to 20% by weight of the primer mix. The added fuel can be either metallic, nonmetallic or combinations thereof An example of a nonmetallic fuel includes nitrocellulose, which is typically added in amounts between about 5 to 15% by weight of the primer mix and more specifically about 6% by weight. In an additional embodiment, nitrocellulose comprises from about 5 to 11% by weight of the primer mix. Nitrocellulose may be added as a doubled-based nitrocellulose. Examples of metallic fuels include aluminum, manganese and titanium or combinations thereof. Metallic fuels are typically added in amounts up to about 10% by weight of the primer mix.

The primer formulations ma:v also contain a binder that is generally included up to 2% by weight of the primer mix to minimize dusting. Typically, about from 0.5 to 1.5% by weight of the primer mix is binder, and more particularly about 0.5% by weight is binder. The binder generally is chosen for maximum compatibility with the explosive formulation prepared. The binder can be selected from a variety of gum materials, such as gum arabics, and particularly acacia gum arabic, as well as polyvinyl alcohol with guar gum. However, gum arabic has been found to be particularly satisfactory.

The disclosed components of the primer mix can be combined and wet mixed by the use of standard low shear mixers, using customary techniques for blending explosives. The components typically are wet-mixed for safety since the explosive compounds are desensitized when mixed with water. With these techniques, the explosive components are generally blended first, followed by the fuels, and finally the oxidizer components.

By way of example and illustration, and not by limitation, the mixing and preparation of the primer mix is illustrated below by the following steps. Other components may be added to the mix as described above, and the recited primer mix is not to be limited by any one proscribed process, but only by the appended claims.

The primer mix may be prepared and applied by the following steps:

1. Within the above-described ranges, primary and secondary explosives are added in a kettle mixer with an amount of water and then mixed for approximately 2 minutes.
2. Within the above-described ranges, bismuth sulfide and additional fuels are added to the wet mix of explosives and then mixed for approximately 2 minutes.
3. Within the above-described ranges, potassium nitrate is added to the wet mix of explosives and fuel and then mixed for about 2 minutes. Subsequently, the entire mixture is mixed for about 3 minutes to form the wet mix primer.
4. The resulting wet primer mix is rolled onto plates having holes or recesses wherein the wet mixture is formed into pellets and then punched and charged into primer cups. The resulting charged primer mix is then covered with a paper foil and an anvil is inserted. The charged primer mix is then typically allowed to dry for 5 days at about 50° C.

The present primer mix generally matches the energetics of currently manufactured formulations based on lead styphnate, as more fully illustrated by the following comparative examples, in which parts and percentages are by weight.

Table 1 illustrates the various components of the present primer mix and their respective percent weights on a dry weight basis. The binder, gum arabic, is added to all six examples in amounts of up to about 0.5% and its percentage is not listed in Table 1 since it comprises so little of the primer mix.

TABLE 1

| EXAMPLE | 1 | 2 | 3 | 4 | 5 | 6 |
|---|---|---|---|---|---|---|
| Bismuth Sulfide | 11.0% | 7.0% | 7.0% | 7.0% | 11.0% | 11.0% |
| Potassium Nitrate | 50.0% | 37.0% | 34.0% | 37.0% | 45.0% | 45.0% |
| Diazodinitrophenol | 28.0% | 33.0% | 30.0% | 30.0% | 28.0% | 28.0% |
| Tetrazene | 5.0% | 8.0% | 8.0% | 8.0% | 5.0% | 5.0% |
| Nitrocellulose | 6.0% | 15.0% | 15.0% | 15.0% | 6.0% | 6.0% |
| PETN | — | — | 3.0% | 3.0% | — | — |
| Aluminum | — | — | 3.0% | — | — | — |
| Glass | — | — | — | — | 5.0% | — |
| Manganese | — | — | — | 3.0% | — | — |
| Manganese Oxide | — | — | — | — | — | 5.0% |
| Binder-Gum Arabic | | | | | | |

Table 2 illustrates the sensitivity of the inventive primer mix of examples 1–6 as compared to a primer mix formed from lead styphnate. The test was carried out using the BAM Drop Test Fixture procedure which is a conventional drop test well known to those skilled in the art. The 50% fire height and standard deviation test results are presented in Table 2, where the 50% fire height is the height at which 50% of the primer fires and 50% of the primer fails to fire. All heights are given in inches.

TABLE 2

| Ballistic Drop Test | 1 | 2 | 3 | 4 | 5 | 6 | Lead Styphnate Based Primers |
|---|---|---|---|---|---|---|---|
| 50% Fire Height | 4.84" | 4.12" | 5.28" | 4.46" | 3.9" | 4.24" | 3.80" |
| Standard Deviation | 0.82 | 0.77 | 0.90 | 1.08 | 0.98 | 1.05 | 0.64 |

Table 3 illustrates the tested ballistic properties for examples 1–6 and a lead styphnate primer. The primers were placed in 9-mm Luger cartridges and tested for ballistic properties as compared to a current styphnate-based primer.

TABLE 3

| | 1 | 2 | 3 | 4 | 5 | 6 | Lead Styphnate Based Primers |
|---|---|---|---|---|---|---|---|
| Average Chamber Pressure (psi) | 34300 | 34000 | 34800 | 34100 | 34000 | 33300 | 35000 |
| Average Veolocity (fts) | 1195 | 1220 | 1225 | 1215 | 1215 | 1217 | 1220 |

While Applicants have set fourth embodiments as illustrated and described above, it is recognized that numerous variations may be made with respect to relative weight percentages of various constituents in the composition. Therefore, while the invention has been disclosed in various forms only, it will be obvious to those skilled in the art that many additions, deletions and modifications can be made without departing from the spirit and scope of this invention, and no undue limits should be imposed, except as to those set forth in the following claims.

What is claimed is:

1. A non-toxic primer mix comprising:

approximately 2–20% by weight bismuth sulfide;

approximately 25–70% by weight potassium nitrate; and approximately 25–50% by weight of a lead-free explosive material.

2. The non-toxic primer mix of claim 1, wherein the explosive material is selected from the group consisting of primary and secondary explosives.

3. The non-toxic primer mix of claim 1, wherein the explosive material comprises diazodinitrophenol and tetrazene.

4. The non-toxic primer mix of claim 3, wherein the explosive material comprises between about 25–33% by weight diazodinitrophenol and about 4–10% by weight tetrazene.

5. The non-toxic primer mix of claim 1, further including approximately 2–20% by weight of a fuel.

6. The non-toxic primer mix of claim 5, wherein the fuel is selected from the group consisting of metallic and nonmetallic fuels.

7. The non-toxic primer mix of claim 6, wherein the metallic fuel is selected from the group consisting essentially of aluminum, manganese and titanium.

8. The non-toxic primer mix of claim 6, wherein the nonmetallic fuel comprises nitrocellulose.

9. The non-toxic primer mix of claim 1, further comprising a binder.

10. The non-toxic primer mix of claim 9, wherein the binder comprises a gum material.

11. The non-toxic primes mix of claim 1, further including pentaerythritol tetranitrate (PETN).

* * * * *